US005208410A

United States Patent [19]

Foley

[11] Patent Number: 5,208,410

[45] Date of Patent: May 4, 1993

[54] ADJUSTABLE BRIDGE FOR ACOUSTIC GUITAR

[76] Inventor: William S. Foley, 1425 Inglis Ave., Columbus, Ohio 43212

[21] Appl. No.: 683,852

[22] Filed: Apr. 11, 1991

[51] Int. Cl.[5] ..... G10D 3/04

[52] U.S. Cl. ..... 84/307; 84/298

[58] Field of Search ..... 84/307, 308, 309, 298, 84/299

[56] References Cited

U.S. PATENT DOCUMENTS 4,230,014 10/1980 Hoshino ..... 84/299
4,625,613 12/1986 Steinberger ..... 84/298
4,867,031 9/1989 Fender ..... 84/298
4,911,055 3/1990 Cipriani ..... 84/299
4,951,543 8/1990 Cipriani ..... 84/298

*Primary Examiner*—Michael L. Gellner
*Assistant Examiner*—Cassandra Spyrou
*Attorney, Agent, or Firm*—Frank H. Foster

[57] ABSTRACT

An improved acoustic guitar bridge having string intonation, height, and tilt adjustment and comprising an anchor joined to and protruding downwardly from a chassis housing a plurality of forwardly and rearwardly adjustable saddles. Stabilizer legs 20 for height adjustment and chassis 10 tilt control extend down from the chassis.

3 Claims, 3 Drawing Sheets

ADJUSTABLE BRIDGE FOR ACOUSTIC GUITAR

TECHNICAL FIELD

This invention relates to guitars, specifically to an improved bridge for an acoustic guitar.

BACKGROUND ART

Most, if not all, guitar players prefer that their instruments intonate correctly. That is to say, that their guitars play equally in tune at all points on the fingerboard. Correct intonation is achieved by the use of a bridge having means for the length adjustment of each string.

Virtually all acoustic guitars now in existence have no means for such adjustment. Their string lengths are determined by the location of one non-adjustable saddle installed on the instrument at the time of its manufacture.

Heretofore, a wide variety of bridges have been proposed and implemented for intonation adjustment.

One such bridge consisted of a slotted, wooden base whereby a saddle piece could be moved from one slot to the next to change the string length. This concept is illustrated in U.S. Pat. No. 934,678. This bridge had to be installed at the time of the instrument's manufacture or else undesirable modification and possible damage would have to be done to the guitar. Furthermore, it did not provide the continuous string length adjustment required for precise intonation. Users found this type of bridge unsatisfactory.

A variety of other adjustable bridge mechanisms are illustrated in the following U.S. Pat. Nos. 490,528; 688,272; 4,208,941; 4,464,970; and 4,768,414.

U.S. Pat. No. 4,768,414 shows small individual adjustable saddle units, one for each string and fitting in the anchor slot of the bridge. However, this structure has the disadvantage that when a string breaks, the adjustable saddle unit under the broken string can fall out and be lost.

U.S. Pat. No. 282,147 shows a bridge height adjustment.

Another bridge consisted of a metal chassis with six movable saddles for string length adjustment. While this bridge worked for solid body and archtop electric guitars, it was undesirable for acoustic guitars. Users found that the weight of the metal bridge subdued the vibration of the top of the instrument, diminishing the guitar's volume and tone. Furthermore, use of such bridge required extensive, irreversible modification to the acoustic guitar, greatly lowering the resale value of the instrument. In essence, guitarists found this type of bridge to be unusable on acoustic guitars. Examples of such adjustable bridges are found in U.S. Pat. Nos. 2,740,313 and 2,793,557.

Most guitarists, therefore, would find it desirable to have an intonation adjustable acoustic guitar bridge that is easy to install, yet does not detract from the instruments original utility. Desirably, it would not require any permanent modification of the guitar so it would allow the guitar to be changed back to its original condition.

Accordingly, the following are objects and advantages of the invention: to provide a bridge for individual string length adjustment for use on the acoustic guitar, to provide a bridge which anchors in the acoustic guitar's original saddle slot but can't fall out if one or several strings break, and which make any modification to the instrument unnecessary, and to provide a bridge with simultaneous string height and chassis tilt adjustment which allows the player to choose a comfortable playing feel and secures the bridge for improved note sustaining characteristics and prevents undesirable warpage and accompanying noise from the bridge.

In addition, there are the following additional objects and advantages: to provide an adjustable bridge for acoustic guitar that is inexpensive to manufacture, thus affordable to virtually every guitar owner, and to provide a bridge that allows for unobvious acoustic resonance and accompanying increase in sustaining characteristics of notes made possible by the precise harmonic tuning of string length.

Readers will find further objects and advantages of the invention from a consideration of the ensuing description and the accompanying drawings.

BRIEF DESCRIPTION OF THE INVENTION

A replacement adjustable saddle member has an elongated chassis with a plurality of pockets formed in its top side and an elongated anchor protruding downwardly from its bottom side. The anchor is dimensioned to fit matingly into engagement in the anchor slot of the original bridge. A plurality of slidably adjustable saddles are mounted in the pockets and are retained in positions selected to attain proper intonation. Preferably, a plurality of stabilizing legs adjustably extend through the chassis to abut the string base of the bridge and support the chassis and permit height and tilt adjustment.

Figure 1:
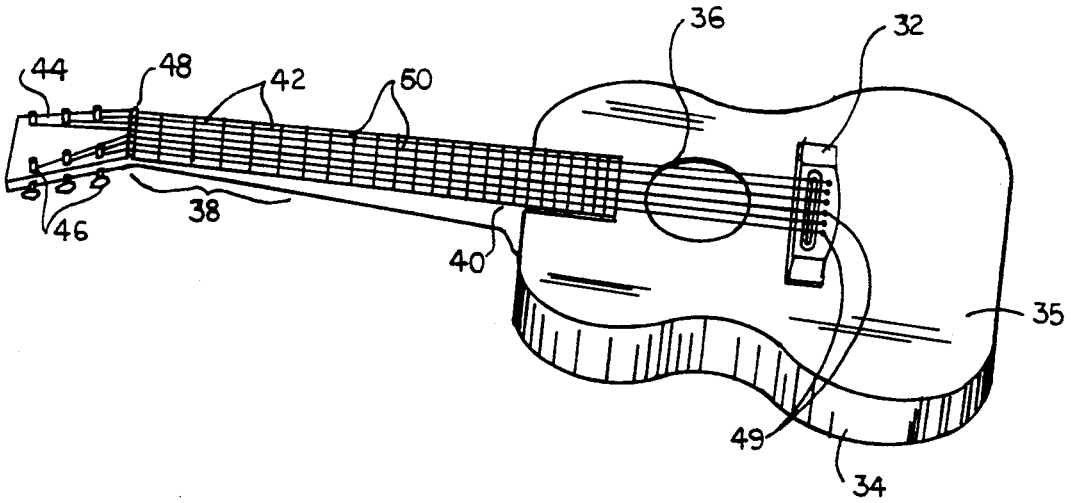
FIG. 1 shows a perspective top view of an acoustic guitar.
Figure 2:
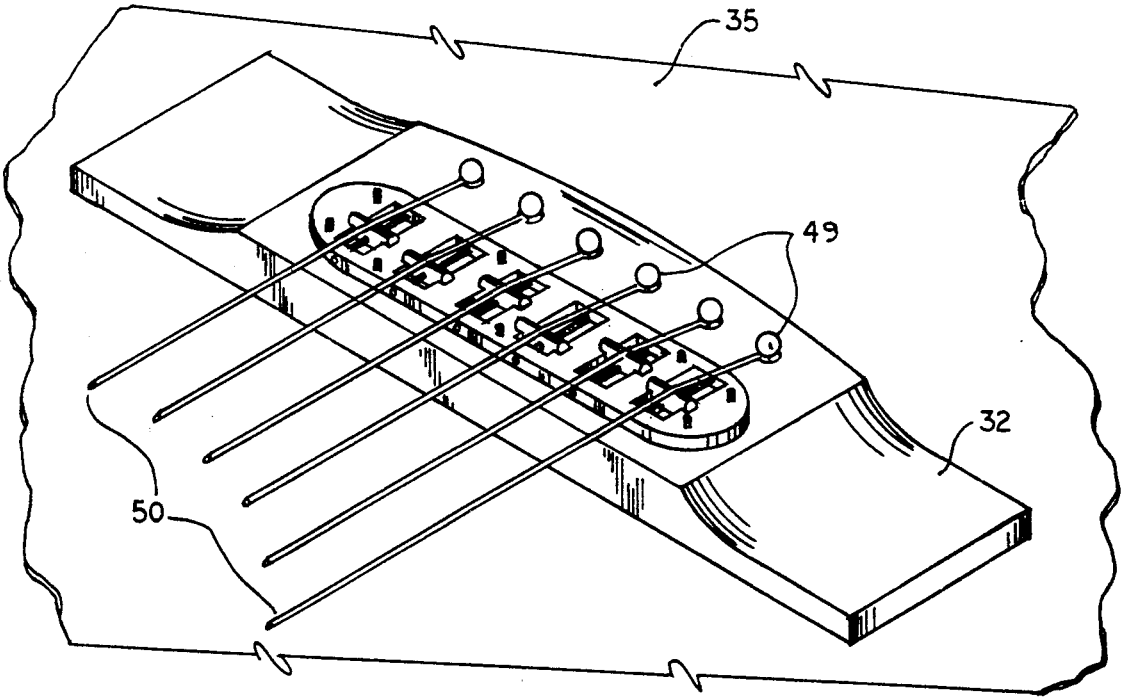
FIG. 2 shows sectional top view of such guitar with adjustable bridge mounted and strung.

10 chassis
12 anchor for 10
14 saddle
16 intonation adjustment screw for 14
18 saddle pocket containing 14, 16, and 26
20 stabilizer/height adjustment screw for 10
22 saddle pocket division
24 saddle pocket edge wall
26 saddle positioning spring
28F nonthreaded hole for 16, front of 10
28R nonthreaded hole for 16, rear of 10
29 threaded hole for 16
30 threaded hole for 20
32 string base
33 slot for 12
34 guitar body
35 top of 34
36 soundhole of 34
37 string seating hole on 32
38 guitar neck
40 fingerboard of 38

42 frets on 40
44 headstock of 38
46 tuning machines on 44
48 string nut
49 end pins
50 guitar strings In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

Figure 3:
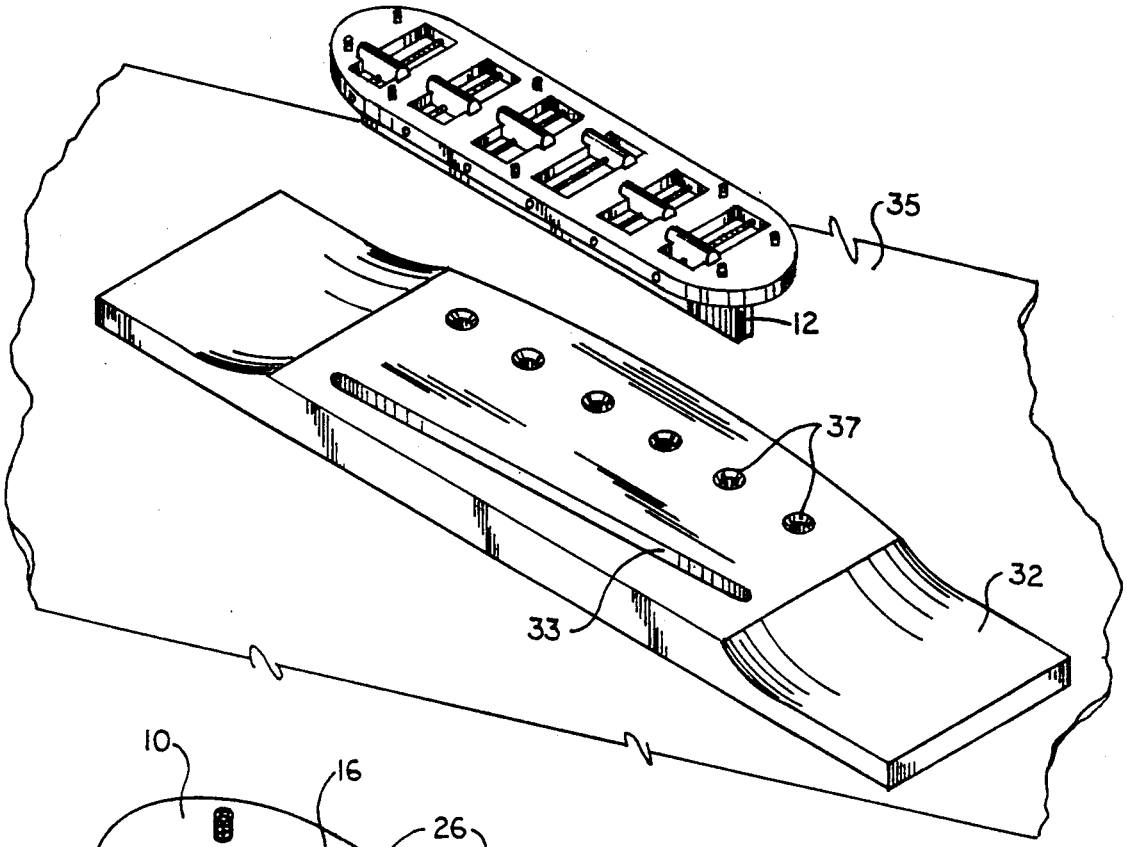
FIG. 3 shows a sectional top view of such guitar with elevated bridge assembly.
Figure 4:
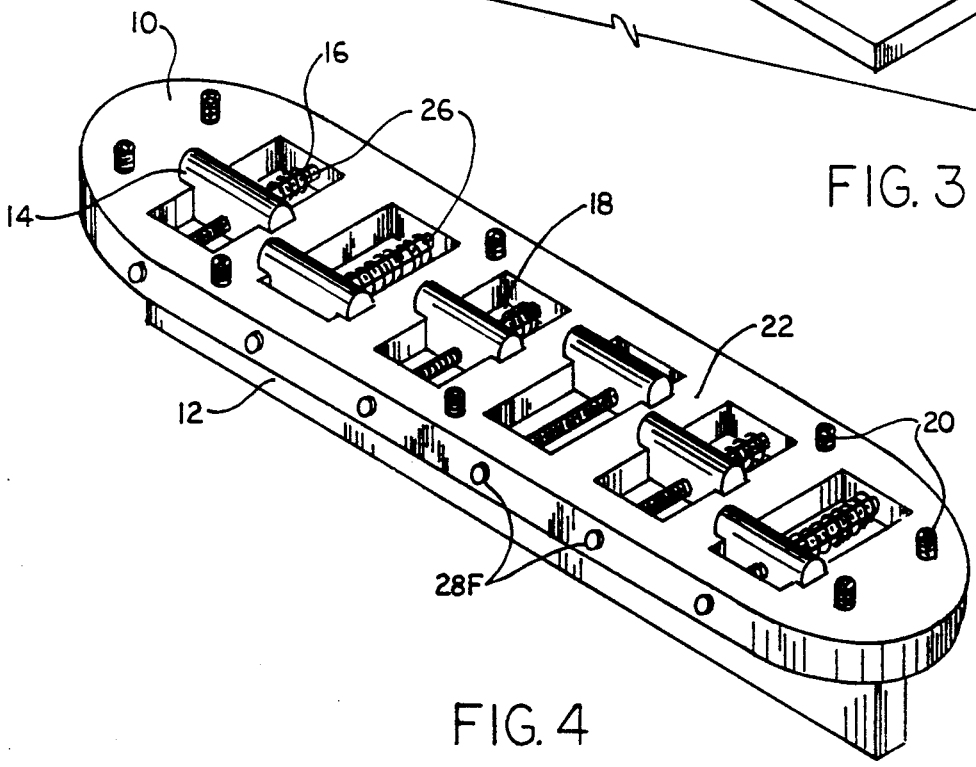
FIG. 4 shows a perspective top view of adjustable bridge.

FIG. 4 shows an adjustable bridge according to the preferred embodiment of the invention. The adjustable bridge comprises an anchor 12 which is affixed to a chassis 10. Both anchor 12 and chassis 10 are made from a rigid, lightweight, unbreakable plastic capable of holding screw threads. The topside and underside of chassis 10 conform to a slight arc which is best illustrated in FIG. 7, which shows a rear view of the adjustable bridge. The bottom of the anchor 12 is flat, which also can be viewed in FIG. 7. Passing vertically through the chassis 10 and located strategically across the chassis 10 expanse are several stabilizer/height adjustment screws 20. Stabilizer/height screws 20 are shown inserted in FIGS. 3, 4, 6, and 7, and are shown in exploded view in FIG. 5.

In the preferred embodiment in FIG. 4 there are six saddle pockets 18 in the chassis 10. They are separated by five saddle pocket divisions 22. In each saddle pocket 18 in FIG. 4 are a saddle 14, an intonation adjustment screw 16, and a saddle positioning spring 26. In the front and rear of each saddle pocket 18 is a saddle pocket wall 24. Each saddle pocket wall 24 contains an intonation screw hole, nonthreaded 28F and 28R which passes through to the outside edge of the chassis 10.

Figure 5:
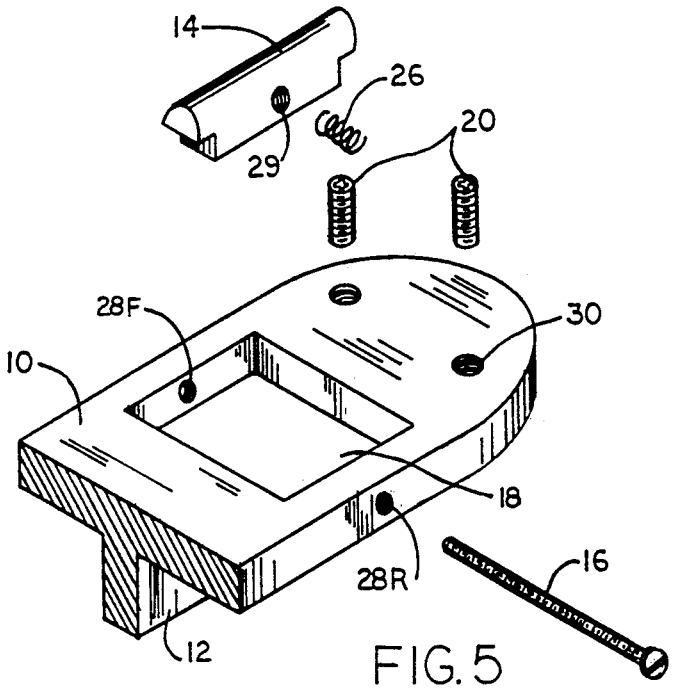
FIG. 5 shows an exploded sectional top view of such bridge.

FIG. 5 shows an exploded view of an individual saddle pocket assembly. An intonation screw 16 loads through the rear intonation screw hole, nonthreaded 28R of the chassis 10. Entering the saddle pocket 18, the intonation screw 16 passes through a saddle positioning spring 26 before entering the intonation screw hole, threaded 29 of the saddle 14. Exiting the opposite side of the saddle 14, the intonation screw 16 comes to rest in the intonation screw hole, nonthreaded 28F in the front of the chassis 10.

Operation

Intonation is the relation of pitch to key or harmony. Correct intonation is achieved on a guitar, illustrated in FIG. 1, when a string 50 plays in tune with itself at each fret 42 location up and down the fingerboard. The correct intonation length of a string varies according to the string's diameter, mass, construction, and pitch. Since there are six different strings on the typical acoustic guitar, there must be six different precisely adjusted string lengths in order to achieve correct intonation.

The adjustable bridge is shown in FIG. 3 loading into the string base 32 of an acoustic guitar. The anchor 12, which may be built in different thicknesses to accommodate different instruments' requirements, retrofits securely in the anchor slot 33 of the string base 32. The flat bottom of the anchor 12 comes to rest on or near the bottom of the anchor slot 33, which is also flat. Since the topsides of many string bases 32 have a slight convex curvature, the underside of the chassis 10 has a slight, matching arch, as seen in FIG. 7. This feature allows for low string height adjustment if so desired by the player.

Figure 6:
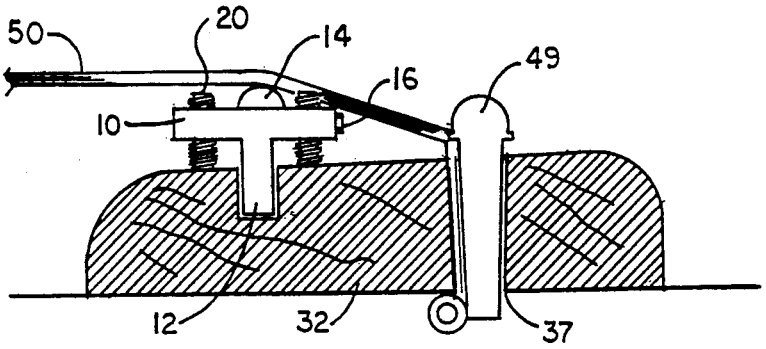
FIG. 6 shows an edge view of such bridge loaded in string base.
Figure 7:
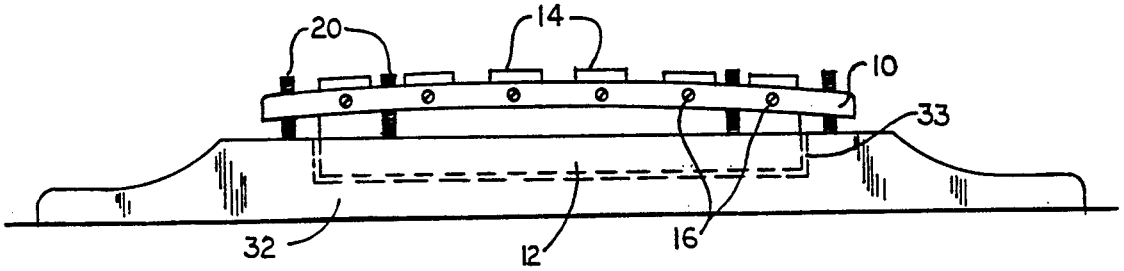
FIG. 7 shows a rear view of such bridge.

Since the topsides of many string bases 32 also angle upwards from the anchor slot 33 to the string seating hole 37, as seen in FIG. 6, the chassis 10 is provided with several stabilizer/height adjustment screws 20 functioning as support legs. These screws 20 provide multiple functions among which are: the anchoring of the chassis 10 securely on top of the string base 32, no matter how the top of the string base 32 is contoured, the providing of extra chassis 10 support, due to the screws' 20 strategic locations, where the forces from the resting intonated strings are the greatest, and the providing of string height and chassis tilt adjustment by the raising and lowering of the chassis 10.

Preferably, there are two adjustment screws at each end of the chassis and several adjustment screws interposed between the ends, all forming stabilizing legs. The interposed adjustment screws are located on the side of the chassis where a nearby saddle is expected to be positioned for proper intonation. This places them nearest the downward component of force exerted by the string on the saddle. The adjustment screws support the saddle member chassis against both tilt and any accompanying movement of the anchor within the anchor slot as well as against chassis deformation by the downward force components.

Once the adjustable bridge is seated in the anchor slot 33 of the string base 32, as in FIG. 6, the guitar may be strung, string-height adjusted, and intonated.

The acoustic guitar in FIG. 1 is strung by loading the ball end of the string 50 in FIG. 6 into the string seating hole 37, securing it there with an end pin 49, and passing the string 50 over the saddle 14. From there the string 50 extends the full length of the fingerboard 40 in FIG. 1 and seats in the nut 48 before wrapping around a tuner 46 located on the headstock 44. The tensioning on the string 50 is then increased by turning the tuner 46 until the desired pitch is achieved. All six strings 50 are put on the guitar in this manner.

When the strings 50 are at the desired pitch, the string height may be adjusted for the player's preference. String height from the fingerboard 40 in FIG. 1 is increased by clockwise rotation of the stabilizer/height screws 20 in FIG. 6. String height is decreased by counterclockwise rotation of the stabilizer/height screws.

When the string height is satisfactory, individual string intonation may be adjusted. On any given string 50 in FIG. 1, if the pitch of the note is found to be sharp at a majority of the fret 42 positions, then that string 50 needs to have its length increased. This may be done by turning the intonation adjustment screw 16 in FIG. 6 clockwise, drawing the saddle 14 continuously toward the rear of the chassis 10. Subsequent testing of the string 50 pitch at different fret 42 locations will determine when the proper string 50 length has been achieved.

Likewise, if the pitch of the note is found to be flat at a majority of the fret 42 positions, then that string 50 needs to have its length shortened. This may be done by turning the intonation screw 16 counterclockwise, pushing the saddle 14 continuously toward the front of the chassis 10.

Thus, the reader will see that the adjustable bridge of the invention provides an easily installed, intonation, height, and tilt adjustable, yet economical guitar bridge which can be used by guitar players on the vast majority of acoustic guitars already in existence, as well as on those in production.

While the above description contains many specificities, the reader should not construe these as limitations on the scope of my invention, but merely as an exemplification of one preferred embodiment thereof.

Many other variations are possible. For example, skilled artisans will readily be able to change the dimensions and shapes of the embodiment. They will be able to make the bridge out of alternative materials, such as brass, aluminum, steel, and other metals and metal alloys, different plastics, wood, ceramics, graphite, and various synthetic materials. They can make many variations on the features of the bridge. They can make it with more, less, or none of the stabilizer/height adjustment screws 20 of FIGS. 4 to 7. They can make it with different anchor 12 thicknesses and heights, as seen in FIGS. 4 to 6. They can also make it with different saddles 14 and saddle adjustment mechanisms 16 and 26 as viewed in FIGS. 4 and 5. They can add height adjustment screws as well as piezo-electrical pickup contacts to the bottom of the anchor 12 in FIGS. 4 to 7. They can also make the adjustable bridge a two piece assembly by making the anchor 12 detachable from the chassis 10, shown in FIG. 4. They can also make the bridge in different forms to accommodate, but not limited to four, five, seven, eight, ten, and twelve string applications. Accordingly, the reader is requested to determine the scope of the invention by the appended claims and their legal equivalents, and not by the examples which have been given.

While certain preferred embodiments of the present invention have been disclosed in detail, it is to be understood that various modifications may be adopted without departing from the spirit of the invention or scope of the following claims.

I claim:

1. A replacement adjustable saddle member for mounting to a string base of a stringed instrument having strings supported between a head stock at a distal end of a fingerboard and a string anchoring means on an instrument body, the string base having an anchor slot interposed between the string anchoring means and the headstock, the saddle member providing intonation, height and tilt adjustment and comprising:

(a) an elongated chassis having a plurality of pockets formed in a top side between opposite ends of the chassis and an elongated anchor protruding downwardly from a bottom side dimensioned for mating engagement in the anchor slot;

(b) a plurality of saddles mounted in the pockets of the chassis for slidable adjustment along axes parallel to the strings;

(c) means for adjustably retaining the saddles in a selected position; and (d) a plurality of stabilizing legs adjustably engaged transversely to the chassis and having ends abutting a top surface of the string base for adjusting the height and inclination of the chassis above the string base.

2. A saddle member in accordance with claim 1 wherein at least two of said adjustable stabilizing legs are attached at each of said opposite ends of the chassis and a plurality of the interposed adjustable legs are positioned at alternate forward and rearward edges of the chassis.

3. A saddle member in accordance with claim 2 wherein each of said legs comprises a screw threadedly engaged to and extending through the chassis.

* * * * *